US006061994A

United States Patent [19]

Goer et al.

[11] Patent Number: 6,061,994

[45] Date of Patent: May 16, 2000

[54] SPACING PROFILE FOR DOUBLE-GLAZING UNIT AND DOUBLE-GLAZING UNIT

[75] Inventors: Bernhard Goer, Recklinghausen; Franz-Josef Rotmann, Essen; Juergen Regelmann, Witten, all of Germany

[73] Assignee: Flachglas Aktiengesellschaft, Fuerth, Germany

[21] Appl. No.: 09/300,306

[22] Filed: Apr. 27, 1999

[30] Foreign Application Priority Data

Apr. 27, 1998 [DE] Germany ..... 298 07 418 U

[51] Int. Cl.[7] ..... E06B 6/663

[52] U.S. Cl. ..... 52/786.13; 52/172; 52/656.5; 52/730.4

[58] Field of Search ..... 52/786.13, 786.1, 52/172, 656.5, 730.4

[56] References Cited

U.S. PATENT DOCUMENTS 4,608,796 9/1986 Shea, Jr. ..... 52/209 X
4,719,728 1/1988 Eriksson et al. ..... 52/786.13 X
5,079,054 1/1992 Davies ..... 52/786.13 X

FOREIGN PATENT DOCUMENTS 33 02 659 A1 8/1984 Germany .
298 14 768 U1 2/1999 Germany .

*Primary Examiner*—Christopher T. Kent
*Attorney, Agent, or Firm*—Marshall & Melhorn

[57] ABSTRACT

A spacing profile for a spacing frame, which is to be fitted in the edge area of a double-glazing unit, forming an interspace, with a profile body of material possessing low thermal conductivity and a metal layer, which is bonded to establish a form fit with the locating walls of the profile body intended for contact with the insides of the panes, wherein in each of the locating walls of the profile body a recess is provided, in which is arranged the metal layer, so that the contact surface formed by the profile body and the contact surface formed by the metal layer lie essentially in one plane.

9 Claims, 1 Drawing Sheet

SPACING PROFILE FOR DOUBLE-GLAZING UNIT AND DOUBLE-GLAZING UNIT

BACKGROUND OF THE INVENTION

1. Field of the Invention

The present invention concerns a spacing profile for a spacing frame, which is to be fitted in the edge area of a double-glazing unit thereby forming an interspace, with a profile body of a material possessing low thermal conductivity and with a metal layer, which is bonded to establish a material fit to the locating walls of the profile body which are intended for contact with the insides of the panes.

Within the scope of the invention, the panes of the double-glazing unit are normally of inorganic or organic glass, without of course the invention being restricted thereto. The panes can be coated or finished in any other way in order to impart special functions to the double-glazing unit, such as for example increased thermal insulation or sound insulation.

The profile body of the spacing profile of material possessing low thermal conductivity constitutes, in respect of volume, the main part of the spacing profile and imparts its cross-sectional profile to it.

By "bonded to establish a material fit" is meant that the profile body and the metal layer are durably bonded to one another, for example by coextrusion of the profile body with the metal layer or by laminating the metal layer on separately, if necessary by means of a bonding agent or similar methods.

For some considerable time it has also been the practice to make use of plastic spacing profiles instead of metal spacing profiles for the manufacture of high thermal-insulation double-glazing units in order to take advantage of the low thermal conduction of the former materials.

By materials with low thermal conductivity in the sense of the invention should be understood those which evidence a coefficient of thermal conductivity which is significantly reduced in comparison with metals, that is to say by at least a factor of 10. The coefficients of thermal conductivity $\lambda$ for such materials are typically of the order of 5 W/(m*K) and below; preferably, they are less than 1 W/(m*K) and more preferably less than 0.3 W/(m*K). Plastics generally fall within this definition.

Of course, plastics generally possess low impermeability to diffusion in comparison with metals. In the case of plastic spacing profiles, it is necessary therefore to ensure by special means that atmospheric humidity present in the environment does not penetrate into the interspace to the extent that the absorption capacity of the desiccant generally accommodated in the spacing profiles is not soon exhausted, thus impairing the reliability performance of the double-glazing unit. Furthermore, a spacing profile must also prevent filler gases from the interspace, such as for example argon, krypton, xenon, sulphur hexafluoride, escaping from it. Vice versa, nitrogen, oxygen, etc., contained in the ambient air should not enter the interspace. Where impermeability to diffusion is involved below, this means impermeability to vapor diffusion, as well as impermeability to gas diffusion for the gases stated.

2. Description of the Prior Art

To improve impermeability to vapor diffusion, DE 33 02 659 Al, which has been employed for formulation of the preamble of claim 1, suggests providing a plastic spacing profile with a vapor-diffusion impermeable layer (vapor barrier) by applying, or inserting close to the surface, to the plastic profile, on the side facing away from the interspace in installed state, a thin metal foil or a metallized plastic film. This metal foil must span the interspace as completely as possible so that the desired vapor-barrier effect occurs. Such a spacing profile is then bonded by means of a sealant, preferably a polyisobutylene-based butyl sealant, applied thinly to the contact surfaces of the locating walls, to the insides of the panes by exerting pressure. In order to prevent the sealant entering the interspace, the plastic profile body incorporates, at the ends of its locating walls facing towards the interspace, contact ribs projecting in each case significantly past the contact surfaces which come in direct contact with the panes on application of pressure. It has been found detrimental that the sealant coating, as a result of the pressure of adjacent contact ribs, is frequently not sufficiently bonded to the pane surface, so that adhesion of the sealant to the inside of the pane is inadequate.

Another spacing profile is known from DE 298 14 768 U1 of earlier priority date. This high thermally insulating spacing profile comprises a desiccant cavity formed by the plastic profile body, at both sides of which are provided contact flanges for contact with the insides of the panes, which are joined by means of bridge sections to the cavity. On the outside facing away from the interspace in installed state is provided a metal layer which can also extend around the contact flanges as far as their contact surfaces. This embodiment has proved advantageous, as by means of a metal surface, it is frequently possible to achieve better adhesion of the profile to the sealant materials generally used, than is the case with a plastic surface. Here, however, the following problems are observed if one extends the metal layer over the entire locating wall as far as its end facing towards the interspace, it can easily happen during handling, for example when cutting to length or bending the profile, that the free end of the metal layer becomes detached from the locating wall. In addition, it is undesirable for the end of the metal layer to be visible from the interspace. If, on the other hand, one only extends the metal layer over part of the locating wall, it is possible to prevent the metal layer being visible. The separation of the free end of the metal layer described is however also observed in this case. In addition, as a result of this arrangement, a step in the contact surface of the locating wall inevitably occurs at the free end of the metal layer, as a result of which uniform exertion of pressure on a sealant coating applied thinly to the contact surface is rendered difficult or even impossible. Here, the contact surface of the metal layer projecting past the contact surface of the locating wall formed by the profile body by the thickness of the metal layer has an undesirable effect similar to the contact rib in the case of the prior art from DE 33 02 659 Al.

SUMMARY OF THE INVENTION

It is the object of the invention to improve the generic spacing profile such that uniform pressure is also ensured on a sealant coating applied thinly to the locating walls during the manufacture of the double-glazing unit. In addition it is aimed at preventing undesirable separation of the free end of the metal layer more reliably.

According to the invention, it is provided that a recess be provided in each of the locating walls of the profile body, in which the metal layer is arranged such that the contact surface formed by the profile body and the contact surface formed by the metal layer lie essentially in one plane.

As a result of provision according to the invention of a recess accommodating the metal layer in the surfaces of the locating walls facing towards the insides of the panes in installed state, it is achieved that the metal layer is uniformly recessed to a certain degree. In this way, it is possible to prevent the formation of a step in the contact surface which impairs uniform pressure being exerted on the sealant. In addition, the aforementioned separation problems at the free end of the metal layer are better prevented by virtue of its protected arrangement in the recess.

The technical problem which is the basis of the invention is solved to best advantage if the depth of the recess corresponds exactly to the thickness of the metal layer, so that the contact surface formed by the profile body and the contact surface formed by the metal layer lie exactly in one plane, that is to say that a step is completely prevented. It lies within the scope of the invention however for the depth of the recess to deviate, for example on account of manufacturing tolerances, from the ideal depth by up to approximately 50% of the thickness of the metal layer, so that if necessary a very flat step is formed in the contact surface. Here, it is to be taken into account that the sealant is typically applied with a thickness of approximately 0.2–0.4 mm to the locating walls, while suitable metal layers typically possess a thickness of only 0.1 mm or less, so that a step in the contact surface of up to approximately one half metal layer thickness can if necessary be tolerated within the scope of the invention.

Basically, the design of the locating walls covered by the invention is independent of the other profile geometry. Thus, simple box profiles, as are described in DE 33 02 659 Al, can just as well take the form according to the invention as the more complex spacing profiles according to DE 298 14 768 or DE 199 03 661.6 of younger priority, to which reference is made in its entirety to avoid repetition.

Adequate adhesion of the locating walls to the sealant, as well as durable bonding of the metal layer to the profile body in the area of the locating walls is generally achieved if the contact surface formed by the metal layer extends over approximately 20 to 80% of the total contact surface of the locating wall in question.

For the metal layer, it is possible in particular to employ the metal foils or sheets generally used as diffusion-impermeable coatings with plastic spacing profiles. The metal layer can also be applied directly to the profile body with the aid of chemical or physical coating processes. Metal layers applied in adequate thickness are distinguished not only by satisfactory impermeability to diffusion, but also have the further advantage that they are plastically deformable, so that they are suitable for cold-bendable profiles, as are described for example in DE 298 14 768 or DE 199 03 661.6. Such metal layers then act not only as diffusion-impermeable layers, but also, when arranged at suitable places, as reinforcing layers which facilitate bending.

Preferred materials for the metal layer within the scope of the invention are stainless steel or sheet iron coated on at least one surface with material containing chromium and/or zinc, where the coating is essentially thinner than the sheet metal thickness. Sheet iron surface-coated with tin is also termed tinplate. Suitable stainless steel grades are for example 4301 or 4310 according to the German steel coding.

When using coated sheet iron, it should possess a thickness of less than 0.2 mm, preferably maximum 0.13 mm. If stainless steel is used, even thinner layers are possible, that is to say less than 0.1 mm, preferably 0.05 mm. In such cases, the minimum layer thickness should be chosen such that the necessary impermeability to diffusion as well as an approximate mechanical characteristic (for example, bendability) can be achieved. For the materials stated, a minimum thickness of approximately 0.02 mm will be necessary to this end.

Suitable materials with low thermal conductivity for the manufacture of highly thermally insulating spacing profiles for the profile body have proved to be thermoplastics with a coefficient of thermal conductivity $\lambda<0.3$ W/(m*K), for example polypropylene, polyethylene terephthalate, polyamide or polycarbonate. The plastic can contain the usual fillers, additives, pigments, materials for UV protection, etc.

BRIEF DESCRIPTION OF THE DRAWINGS

The invention will be explained below with the aid of the following drawings. They show.

DESCRIPTION OF THE PREFERRED EMBODIMENT

Figure 1:
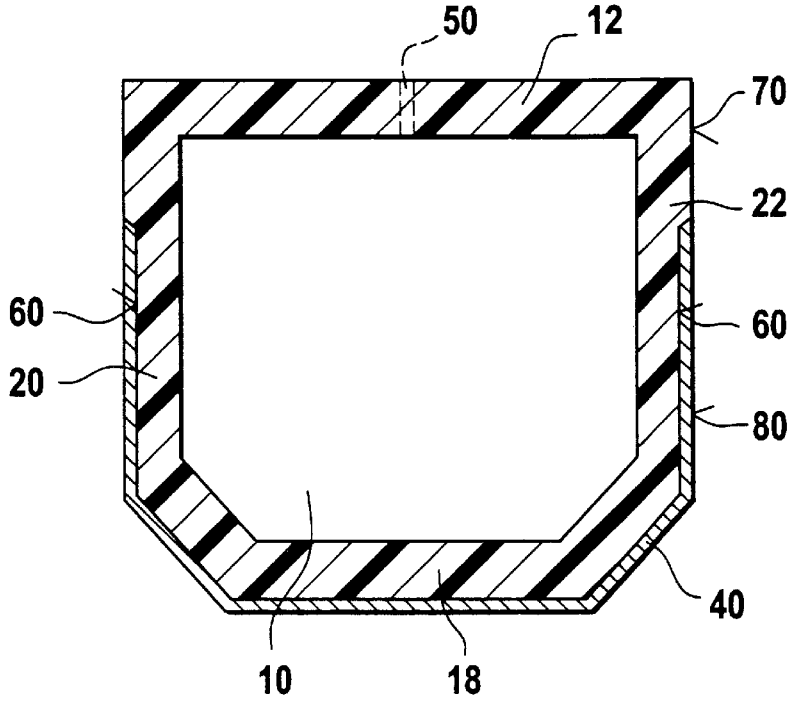
FIG. 1: a first embodiment of spacing profile in cross-section.
Figure 2:
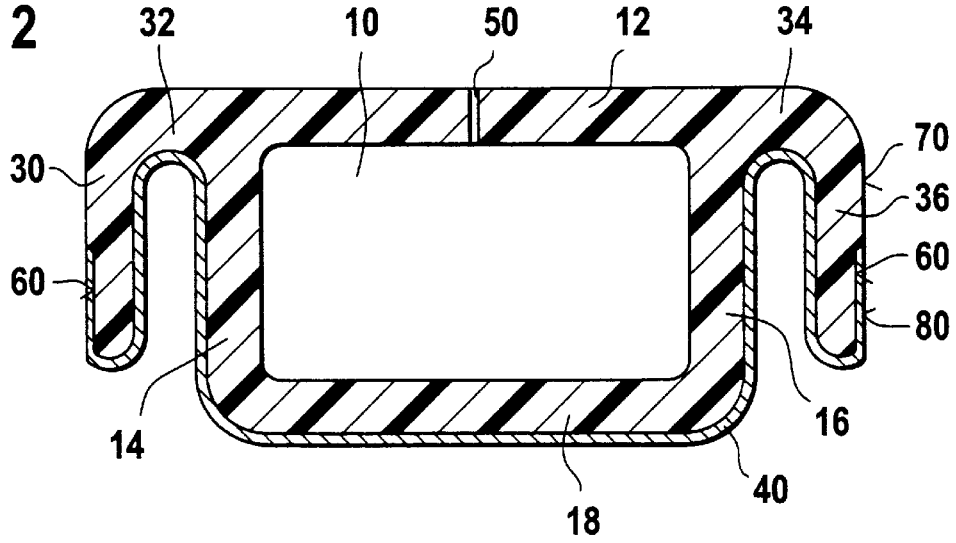
FIG. 2: a second embodiment of the spacing profile in cross-section.

The cross-sections shown in FIGS. 1 and 2 do not normally change over the entire length of a spacing profile, apart from manufacturing tolerances.

FIG. 1 illustrates a first embodiment of a spacing profile according to the present invention. The profile body, consisting for example of black-tinted polypropylene, comprises an inner wall 12 which in installed state faces towards the interspace, two locating walls 20 and 22 intended for contact with the insides of the panes, and a rear wall 18 adjoining them via short transition areas. The approximately 1 mm thick walls 12, 18, 20, 22 define a desiccant cavity 10, which is subsequently filled with hygroscopic materials. To ensure that moisture can enter the desiccant cavity 10 from the interspace, perforations 50 are provided in the inner wall 12.

The locating walls 20 and 22 are each provided with a recess 60 in their surfaces intended for contact with the insides of the panes; this commences at a certain distance from the ends of the locating walls 20, 22 facing towards the interspace and extends over the entire remaining surface. In the recesses 60, as well as on the outside of the rear wall 18 and the transition areas between the locating walls 20, 22 and the rear wall 18, there is a diffusion-impermeable layer 40 of 0.125 mm thick chromized sheet iron also provided with a coating of bonding agent, which is bonded so as to establish a material fit with the profile body. The depth of the recess 60 corresponds exactly to the thickness of the metal layer 40, so that the contact surface 70 formed by the profile body, and the contact surface 80 formed by the metal coating 40 lie exactly in one plane.

The contact surfaces 70, 80 intended for contact with the insides of the panes with the sealant interposed thus have, apart from any manufacturing tolerances present, a smooth surface and form a step-free plane. This ensures in optimum fashion the aims striven for to ensure uniform application of pressure of the spacing profile provided with an approximately 0.25 mm thick coating of sealant on the contact surfaces during manufacture of the double-glazing unit and to counteract separation of the metal layer 40 at its free end.

The contact surface 80 formed by the metal layer 40 in this first example has an area percentage of the total contact area 70, 80 of the locating walls 20, 22 of approximately 65%.

The embodiment of the invention illustrated in FIG. 2 is based on a profile body in accordance with DE 298 14 768 U1. Walls 12, 14, 16, 18 define a desiccant cavity 10, where connection between this cavity 10 and the interspace is established by means of perforations 50 or the like. In installed state, contact flanges 30 and 36 are joined to cavity 10 by means of bridge sections 32 and 34 for contact with the insides of the panes, where the contact flanges 30, 36 each have in their surfaces facing towards the insides of the panes in installed state a recess 60, into which, according to the first embodiment, is inserted a metal layer 40. In this example as well, the depth of the recess 60 corresponds to the thickness of the metal layer 40, so that the contact surfaces 70 and 80, as in the preceding example, lie in one plane. The metal layer 40 continues over the entire remaining outside of the profile. It acts in the area of contact flanges 30, 36 as reinforcing layer permitting cold bending of the profile and is also designed in the entire remaining area as a diffusion-impermeable layer. The contact surface 80 of the metal layer 40 occupies in this second example approximately 50% of the entire contact surface 70, 80 of the contact flanges 30, 36.

The features disclosed in the foregoing description, in the claims and/or in the accompanying drawing may, both separately and in any combination thereof, be material for realizing the invention in diverse forms thereof.

What is claimed is:

1. A spacing profile for a spacing frame, which is to be fitted along an edge area of two panes of a double-glazing unit, forming an interspace between said panes, with a profile body of material possessing low thermal conductivity and having locating walls intended for contact with the insides of the panes, and a metal layer which is bonded to establish a material fit with the locating walls of the profile body, wherein each of said locating walls of the profile body is provided with a recess in which is arranged the metal layer, so that contact surfaces intended for contact with the panes, and defined respectively by the profile body and the metal layer, lie essentially in one plane.

2. The spacing profile of claim 1, wherein the locating walls are formed by contact flanges, each of which is joined by means of a bridge section to a desiccant cavity.

3. The spacing profile of claim 1, wherein the contact surface formed by the metal layer extends over 20 to 80% of the entire contact surface of the locating wall concerned.

4. The spacing profile of claim 1, wherein the metal layer consists of stainless steel or of sheet iron coated with a material containing chromium and/or tin at least on one surface.

5. The spacing profile of claim 4, wherein the metal layer possesses a thickness of at least 0.02 mm.

6. The spacing profile of claim 4, wherein the metal layer is formed of coated sheet iron having a thickness of less than 0.2 mm.

7. The spacing profile of claim 4, wherein the metal layer is formed of stainless steel having a thickness of less than 0.1 mm.

8. The spacing profile of claim 4, wherein the metal layer is formed of coated sheet iron having a thickness of less than 0.13 mm.

9. The spacing profile of claim 4, wherein the metal layer is formed of stainless steel having a thickness of less than 0.05 mm.

* * * * *